US008485602B1

(12) United States Patent
Richards

(10) Patent No.: US 8,485,602 B1
(45) Date of Patent: Jul. 16, 2013

(54) MOTORIZED CHAIR DEVICE FOR INDIVIDUALS WITH LIMITED MOTOR FUNCTION

(76) Inventor: Cheryl S. Richards, Tucson, AZ (US)

( * ) Notice: Subject to any disclaimer, the term of this patent is extended or adjusted under 35 U.S.C. 154(b) by 258 days.

(21) Appl. No.: 13/107,884

(22) Filed: May 14, 2011

Related U.S. Application Data

(60) Provisional application No. 61/334,916, filed on May 14, 2010.

(51) Int. Cl.
*A47C 3/029* (2006.01)

(52) U.S. Cl.
USPC ..... 297/260.2; 5/109

(58) Field of Classification Search
USPC ..... 297/260.2; 5/108, 109
See application file for complete search history.

(56) References Cited

U.S. PATENT DOCUMENTS 3,019,052 A * 1/1962 Zawadzki ..... 297/260.2
4,775,184 A * 10/1988 Larkin ..... 297/260.2
5,368,361 A * 11/1994 Wen-Ming ..... 297/260.2
6,774,589 B2 * 8/2004 Sato et al. ..... 297/260.2

* cited by examiner

*Primary Examiner* — Anthony D Barfield

(57) ABSTRACT

A motorized chair device for promoting movement, balance, and vestibular processing and integration. The chair device features a chair component comprising a back support portion disposed atop a seat portion. The back support portion is formed from a first side panel, a middle panel, and a second side panel connected together, wherein rigid intersections are formed between the side panels and middle panel. A rocking component is positioned below the chair component. The rocking component is shaped to allow the chair component to rock. A motor system is operatively connected to a piston, the piston being mounted to a ground surface. The motor system functions to automatically rock the chair component forwardly and backwardly by pushing against the piston to pivot the device in a forward motion. A control button is operatively connected to the motor system. The control button functions to turn the motor system on and off.

20 Claims, 7 Drawing Sheets

MOTORIZED CHAIR DEVICE FOR INDIVIDUALS WITH LIMITED MOTOR FUNCTION

CROSS REFERENCE

This application claims priority to U.S. provisional application Ser. No. 61/334,916 filed May 14, 2010, the specification of which is incorporated herein by reference in its entirety.

FIELD OF THE INVENTION

The present invention is directed to motorized chairs and motorized seating equipment, more particularly to a motorized rocking chair that provides controlled motion to an individual.

BACKGROUND OF THE INVENTION

The present invention features a motorized chair device, e.g., a motorized rocking chair, which provides controlled motion to an individual. The motorized chair device of the present invention may be particularly useful for individuals with limited motor functions. The motorized chair device may help promote better movement, balance, equilibrium, and vestibular processing and integration.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a motorized chair device 100, e.g., a motorized rocking chair, which provides controlled motion to an individual. The motorized chair device 100 of the present invention may be particularly useful for individuals with limited motor functions. The motorized chair device 100 may help promote better movement, balance, equilibrium, and vestibular processing and integration. In some embodiments, the motorized chair device 100 comprises a chair component 105 comprising a back support portion 120 disposed atop a seat portion 110, the back support portion 120 is formed from a first side panel 111, a middle panel 113, and a second side panel 112 connected together wherein the middle panel 113 is sandwiched between the first side panel 111 and the second side panel 112, wherein a first rigid intersection 114 is formed between the first side panel 111 and the middle panel 113 and a second rigid intersection 115 is formed between the second side panel 112 and the middle panel 113; a leg divider shaft 130 disposed on the seat portion 110 near or at a front surface 118, the leg divider shaft 130 functions to separate a user's legs when seated atop the seat portion 110; a rocking component 205, the chair component 105 is mounted atop the rocking component 205, the rocking component 205 is shaped to allow the chair component 105 to rock forwardly and backwardly; a motor system 310 disposed on the rocking component 205 and operatively connected to a piston 320, the piston 320 being mounted to a ground surface, the motor system 310 functions to automatically rock the chair component 105 forwardly and backwardly by pushing against the piston 320 to pivot the device 100 in a forward motion; and a control button 380 operatively connected to the motor system 310, the control button 380 functions to turn the motor system 310 on and off, the control button 380 is mounted to the back support portion via a temporary attachment means 382, the temporary attachment means 382 allowing a user to choose a position of the control button 380.

In some embodiments, the device further comprises straps 140 disposed on the chair component 105 for securing the user in the chair component 105. In some embodiments, the straps 140 are disposed on the back support portion 120. In some embodiments, the rocking component 205 comprises a first rocker 210 disposed on a first side and a second rocker 220 disposed on a second side.

In some embodiments, the motor system 310 is operatively connected to a control box 340. In some embodiments, the control box 340 allows for manipulation of rocking speed. In some embodiments, the control box 340 allows for manipulation of frequency of rocking. In some embodiments, the motor system 310 is operatively connected to a power source. In some embodiments, the power source is a battery or an electrical outlet. In some embodiments, the motor system 310 is operatively connectable to an electrical outlet via a power cord 350.

In some embodiments, the temporary attachment means 382 is a hook-and-loop fastener mechanism, a magnet mechanism, a snap mechanism, or a combination thereof. In some embodiments, the temporary attachment means 382 is be disposed on the first side panel 111 or the second side panel 112. In some embodiments, the temporary attachment means 382 is disposed along the height of the first side panel 111 or second side panel 112 (e.g., extending from near the top edge of the side panel to near the bottom edge of the side panel, as shown in FIG. 1), allowing the control button 380 to be placed anywhere (or in various places) along the height of the panel. This allows for the device to accommodate the growth of the user. In some embodiments, the control button 380 is further operatively connected to the control box 340.

In some embodiments, the device further comprises a footrest 150 disposed on the rocking component 205 below the seat portion 110 of the chair component 105. In some embodiments, the footrest 150 comprises straps for securing the individual's feet on the footrest 150.

In some embodiments, the first side panel 111, the middle panel 113, and the second side panel 112 are each flat panels. A first angle 301 is formed between the first side panel 111 and the middle panel 113 (the front surfaces of the respective panels). A second angle 302 is formed between the second side panel 112 and the middle panel 113 (the front surfaces of the respective panels).

In some embodiments, the first angle 301 is between about 90 to 179 degrees. In some embodiments, the first angle 301 is between about 25 to 50 degrees. In some embodiments, the first angle 301 is between about 30 to 60 degrees. In some embodiments, the first angle 301 is between about 35 to 60 degrees. In some embodiments, the first angle 301 is between about 40 to 60 degrees. In some embodiments, the first angle 301 is between about 45 to 60 degrees. In some embodiments, the first angle 301 is between about 50 to 70 degrees. In some embodiments, the first angle 301 is between about 60 to 80 degrees. In some embodiments, the first angle 301 is between about 70 to 90 degrees. In some embodiments, the first angle 301 is between about 90 to 100 degrees. In some embodiments, the first angle 301 is between about 100 to 110 degrees. In some embodiments, the first angle 301 is between about 110 to 120 degrees. In some embodiments, the first angle 301 is between about 100 to 120 degrees. In some embodiments, the first angle 301 is between about 110 to 130 degrees. In some embodiments, the first angle 301 is between about 120 to 140 degrees. In some embodiments, the first angle 301 is between about 130 to 150 degrees. In some embodiments, the first angle 301 is between about 140 to 160 degrees. In some embodiments, the first angle 301 is between about 150 to 170 degrees. In some embodiments, the first angle 301 is between about 150 to 179 degrees.

In some embodiments, the second angle 302 is between about 90 to 179 degrees. In some embodiments, the second angle 302 is between about 25 to 50 degrees. In some embodiments, the second angle 302 is between about 30 to 60 degrees. In some embodiments, the second angle 302 is between about 35 to 60 degrees. In some embodiments, the second angle 302 is between about 40 to 60 degrees. In some embodiments, the second angle 302 is between about 45 to 60 degrees. In some embodiments, the second angle 302 is between about 50 to 70 degrees. In some embodiments, the second angle 302 is between about 60 to 80 degrees. In some embodiments, the second angle 302 is between about 70 to 90 degrees. In some embodiments, the second angle 302 is between about 90 to 100 degrees. In some embodiments, the second angle 302 is between about 100 to 110 degrees. In some embodiments, the second angle 302 is between about 110 to 120 degrees. In some embodiments, the second angle 302 is between about 100 to 120 degrees. In some embodiments, the second angle 302 is between about 110 to 130 degrees. In some embodiments, the second angle 302 is between about 120 to 140 degrees. In some embodiments, the second angle 302 is between about 130 to 150 degrees. In some embodiments, the second angle 302 is between about 140 to 160 degrees. In some embodiments, the second angle 302 is between about 150 to 170 degrees. In some embodiments, the second angle 302 is between about 150 to 179 degrees.

DESCRIPTION OF PREFERRED EMBODIMENTS

Referring now to FIGS. 1-7, the present invention features a motorized chair device 100, e.g., a motorized rocking chair, which provides controlled motion to an individual. The motorized chair device of the present invention may be particularly useful for individuals with limited motor functions. The motorized chair device may help promote better movement, balance, equilibrium, and vestibular processing and integration. For example, the device can help an individual develop gross motor arm control. In some embodiments, the motorized chair device helps improve cognizance, head control, eye contact, imitative behaviors, direction-following skills, and visual tracking skills. The device may be particularly soothing to users. Additional benefits may include but are not limited to: provides kinesthesia/sensory system benefits (e.g., provides information from muscles, joints, ligaments), provides internal awareness about body parts to allow user to perform tasks with coordination, provides motor planning (e.g., ability to organize, plan, and execute new or unplanned motor tasks), improves tactile/movement/kinesthetic-proprioceptive processing, increases body awareness, facilitates progress in motor skills, increases independence, teaches cause and effect relationships, teaches how to focus on a purposeful action that the user can control and repeat (e.g., via a switch), facilitates learning, leads to better self-help, communication, and leisure skills, etc.

Figure 1:
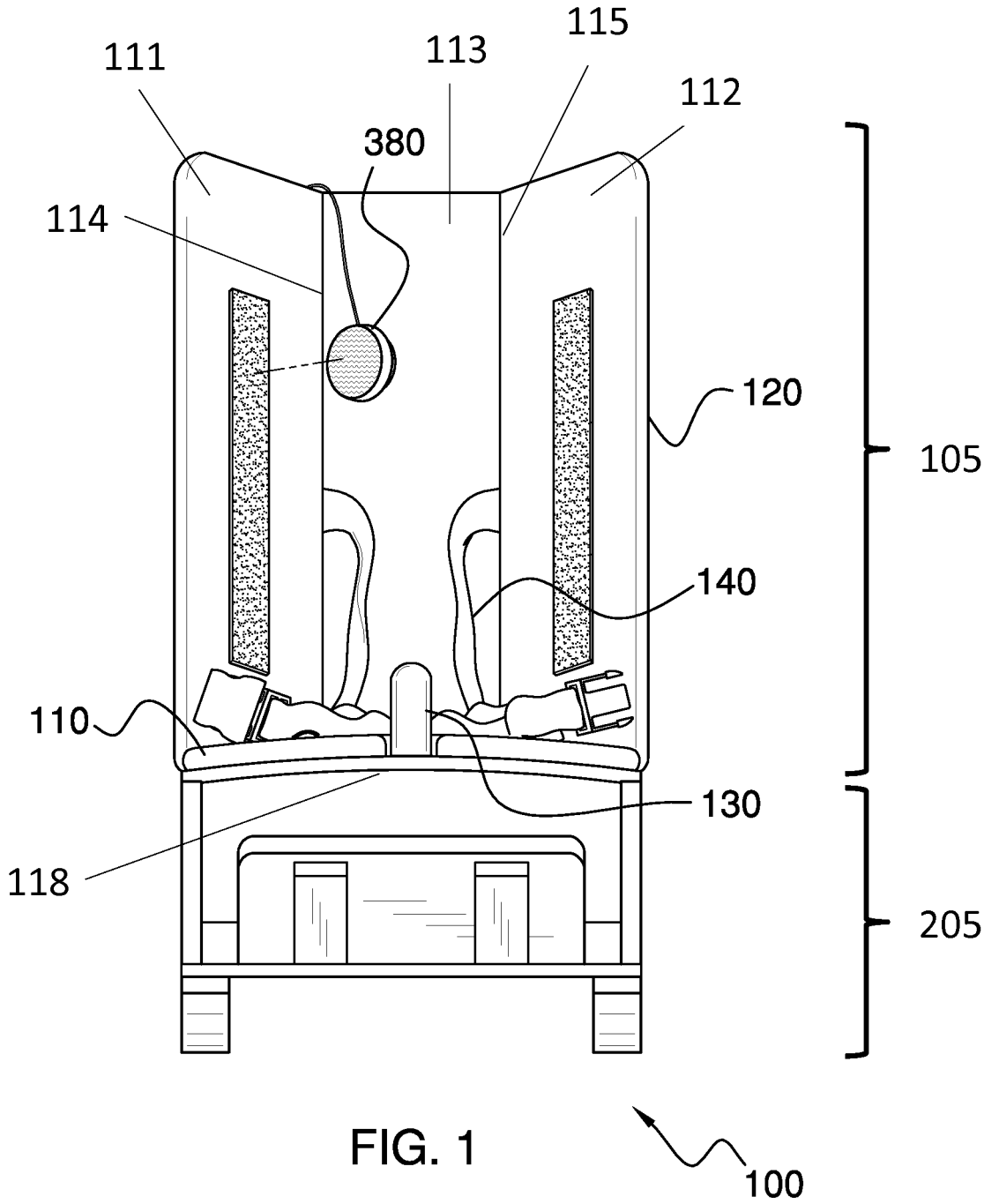
FIG. 1 is a front view of the motorized chair device of the present invention.
Figure 2:
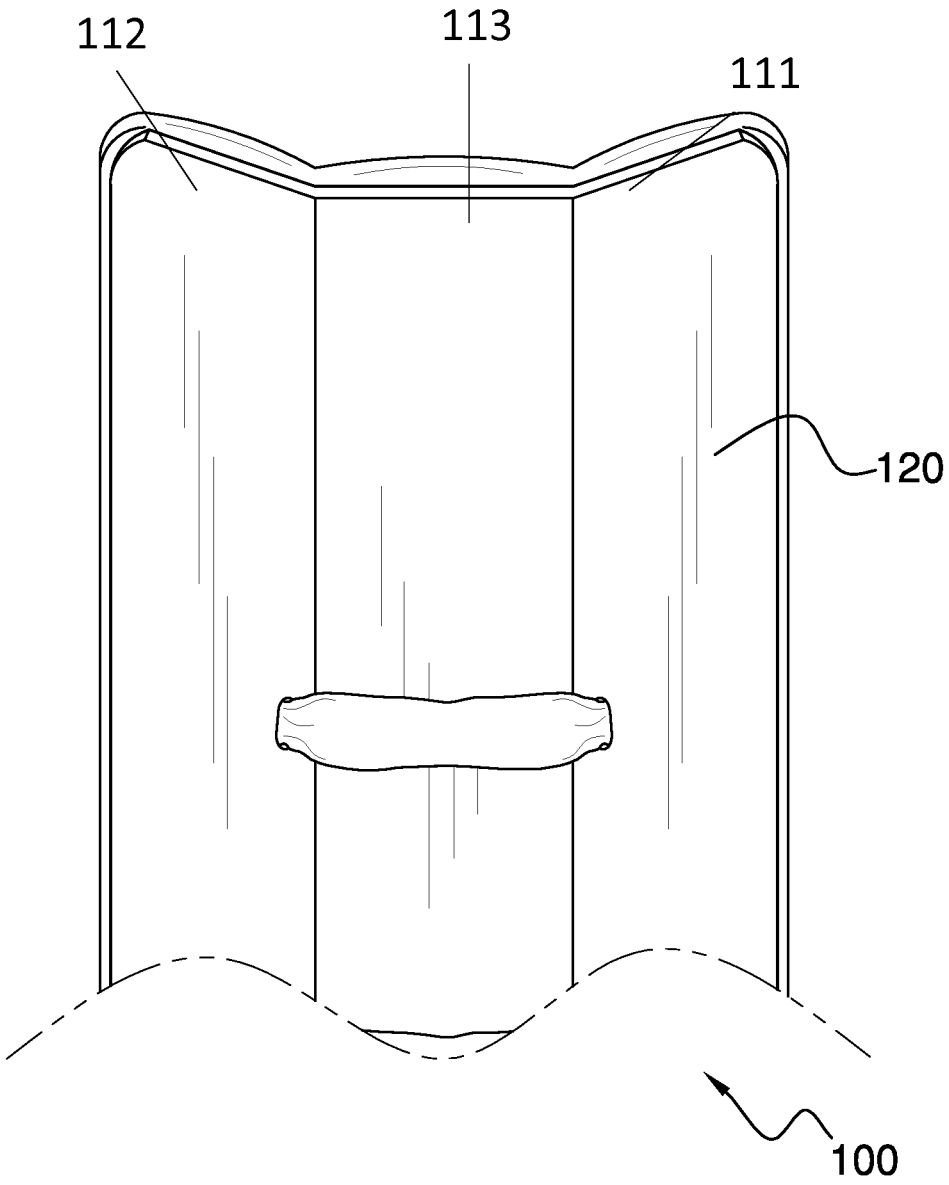
FIG. 2 is a back view of the device of FIG. 1.

The motorized chair device 100 of the present invention comprises a chair component 105. As shown in FIG. 1, the chair component 105 comprises a seat portion 110 and a generally curved back support portion 120. A leg divider shaft 130 (e.g., an abductor) is disposed on the seat portion 110, functioning to separate the user's legs (e.g., help keep the legs from crossing). Straps 140 are disposed on the chair component 105 (e.g., on the back support portion 120) for securing the user in the chair component 105. The chair component 105 may be constructed in a variety of materials, for example the chair component 105 may comprise various materials (e.g., padding, etc.) for providing comfort to a user. FIG. 2 shows a back view of the chair component 105.

Figure 3:
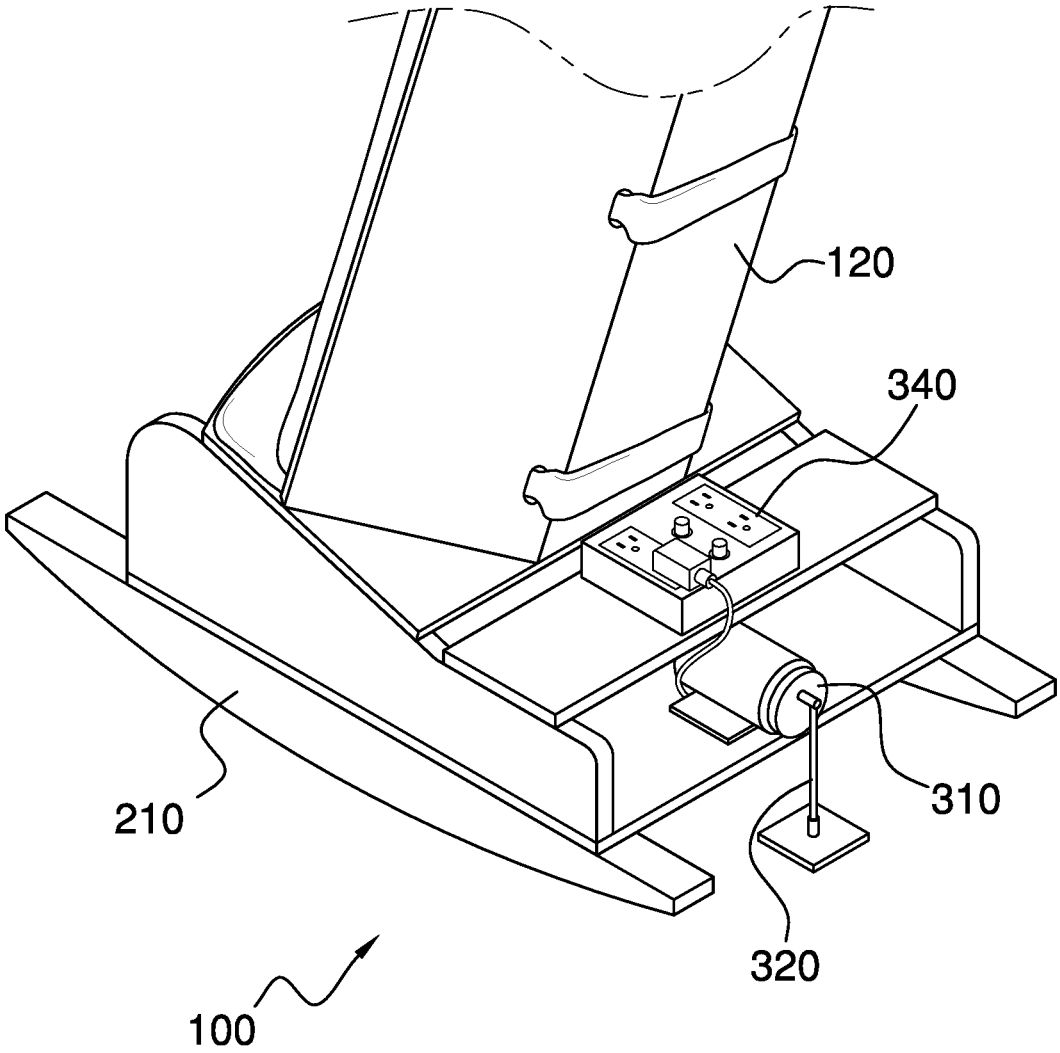
FIG. 3 is a back perspective view of the device of FIG. 1.
Figure 5:
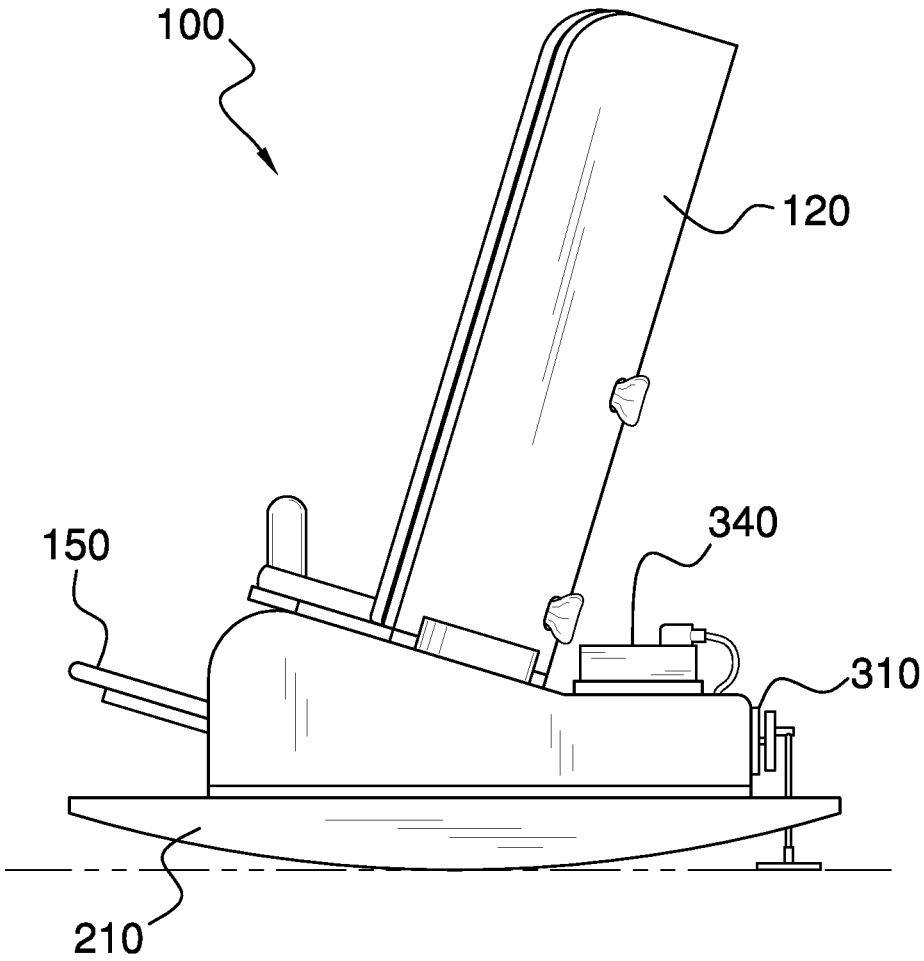
FIG. 5 is a side view of the device of FIG. 1.

Referring now to FIG. 3 and FIG. 5, the chair component 105 is mounted atop a rocking component 205. For example, in some embodiments, the rocking component 205 comprises a first rocker 210 disposed on a first side and a second rocker 220 disposed on a second side. The rocking component 205 allows the device 100 of the present invention to rock like a standard rocking chair, which is well known to one of ordinary skill in the art. As shown in FIG. 3, the chair component 105 is positioned at the front portion of the rocking component 205.

Figure 7:
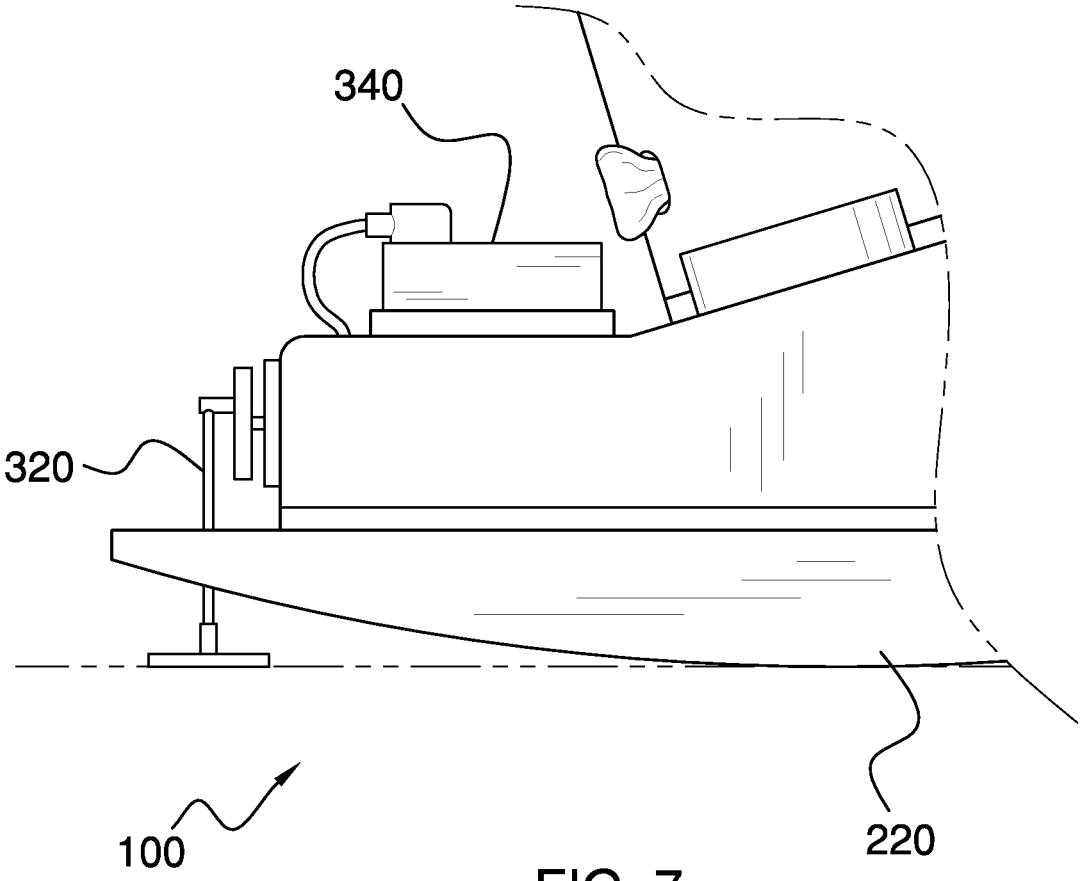
FIG. 7 is a side detailed view of the device of FIG. 6.

A motor system 310 (e.g., 0.07/0.09 TE) is disposed on the back portion of the rocking component 205. The motor system 310 functions to automatically rock the device 100 of the present invention. As shown in FIG. 3 and FIG. 7, the motor system 310 comprises a piston 320 for mounting on a ground surface. The motor system 310 pushes against the piston 320 to pivot the device in a forward direction (e.g., rocking motion).

Figure 4:
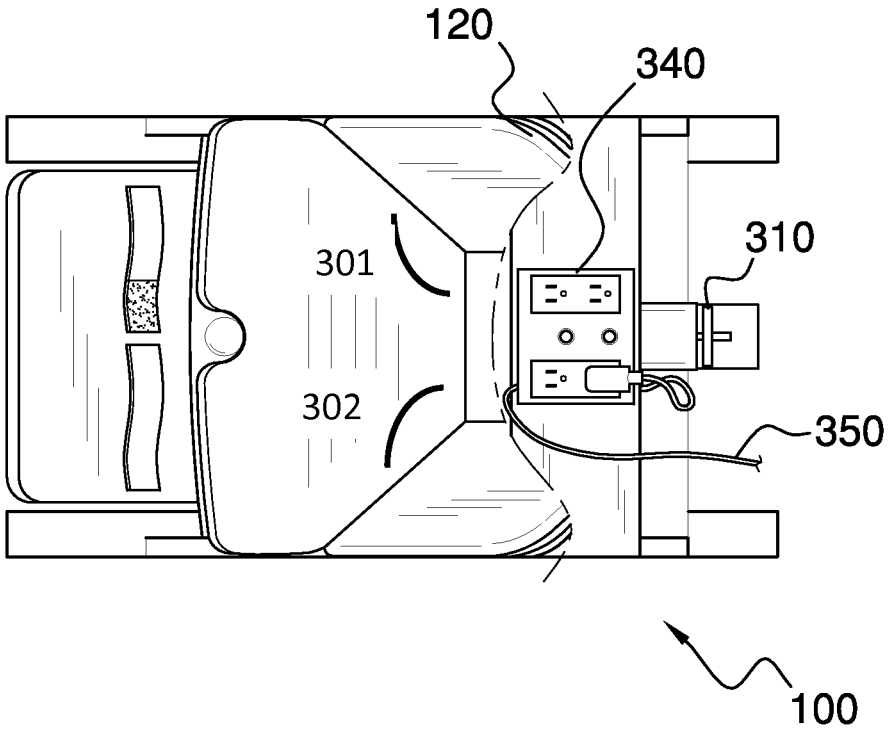
FIG. 4 is a top view of the device of FIG. 1.

Referring now to FIG. 4, the motor system 310 is operatively connected to a control box 340. The control box 340 allows manipulation of the motor system 310, for example rocking speed and frequency can be manipulated. The motor system 310 is operatively connected to a power source. In some embodiments, the power source is a battery (e.g., marine battery) or an electrical outlet. In some embodiments, the motor system 310 is operatively connectable to an electrical outlet via a power cord 350. In some embodiments, the motorized chair device 100 of the present invention further comprises a means of plugging in other devices (e.g., other devices with buttons), so a user can practice turning devices on and off, for example via the push buttons of the devices.

Figure 6:
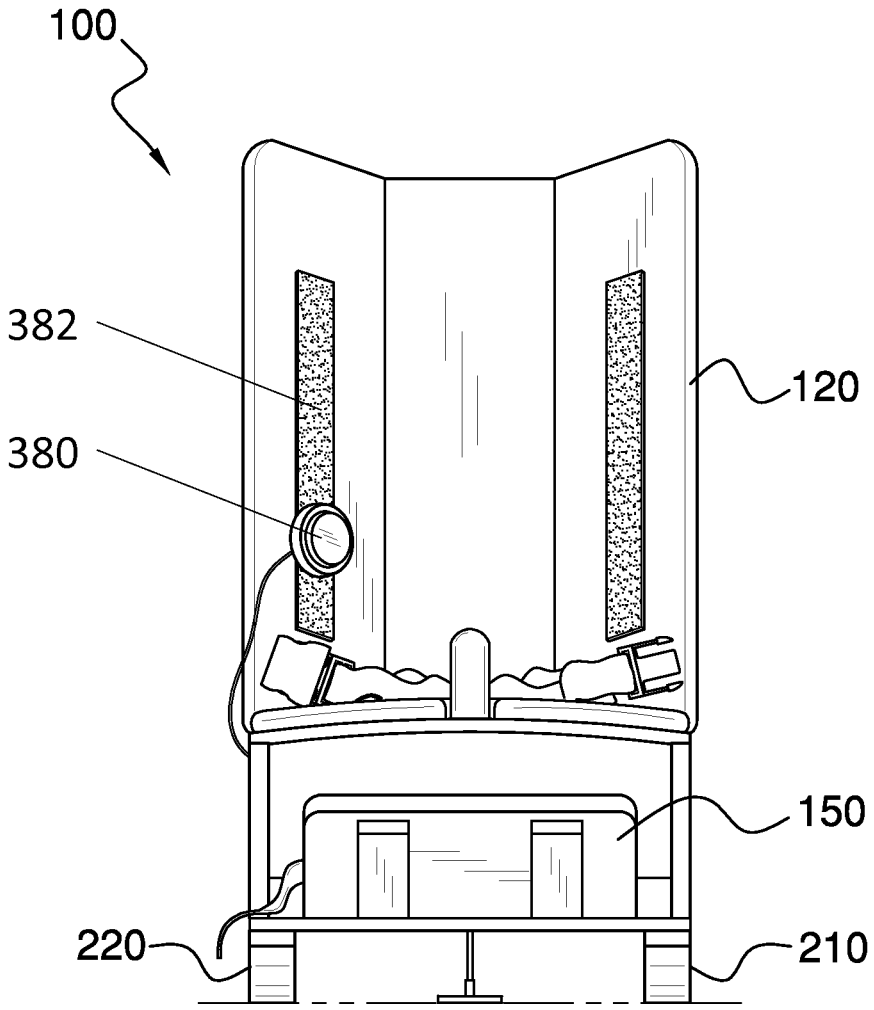
FIG. 6 is a front view of the motorized chair device of the present invention.

As shown in FIG. 5 and FIG. 6, a footrest 150 is disposed on the rocking component 205 below the seat portion 110 of the chair component 105. The footrest 150 may provide comfort to the individual. Straps may also be disposed on the footrest 150 for securing the individual's feet, however the use of the straps is optional.

A user can control the device 100 of the present invention, allowing him/her to determine when he/she wants to engage in the controlled motion (e.g., the user can stop the device if he/she is tired). The device 100 comprises a control button 380 (e.g., see FIG. 1) operatively connected to the control box 340 and/or motor system 310. In some embodiments, the control button 380 is mounted to the device via a temporary attachment means (e.g., hook-and-loop fasteners). In some embodiments, a user may activate the control button 380 by gross motor arm movement. Without wishing to limit the present invention to any theory or mechanism, it is believed that such a control button 380 encourages purposeful movement and refinement of basic movement skills. The control button 380 may teach cause and effect relationships, how to use an object/switch, or how to pay attention. The control button 380 may provide various sensory experiences. The control button 380 may teach how to focus on an action he/she can control and repeat.

As an example, in some embodiments, the device comprises a fractional horse power DC motor, optionally with a speed controller. In some embodiments, the shaft output may be about ¼" to ¾" V long, In some embodiments, the input may be about 115V, which may be converted to about 24V with speed control. The device may comprise a tinier with an on/off feature and time settings, for example for about 5 minutes to about 60 minutes. The device may comprise a remote with an on/off switch feature and/or a momentary switch to start/stop. The present invention is not limited to the aforementioned examples and components.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A motorized chair device 100 comprising:

(a) a chair component 105 comprising a back support portion 120 disposed atop a seat portion 110, the back support portion 120 is formed from a first side panel 111, a middle panel 113, and a second side panel 112 connected together wherein the middle panel 113 is sandwiched between the first side panel 111 and the second side panel 112, wherein a first rigid intersection 114 is formed between the first side panel 111 and the middle panel 113 and a second rigid intersection 115 is formed between the second side panel 112 and the middle panel 113;

(b) a leg divider shaft 130 disposed on the seat portion 110 near or at a front surface 118, the leg divider shaft 130 functions to separate a user's legs when seated atop the seat portion 110;

(c) a rocking component 205, the chair component 105 is mounted atop the rocking component 205, the rocking component 205 is shaped to allow the chair component to rock forwardly and backwardly;

(d) a motor system 310 disposed on the rocking component 205 and operatively connected to a piston 320, the piston 320 being mounted to a ground surface, the motor system 310 functions to automatically rock the chair component 105 forwardly and backwardly by pushing against the piston 320 to pivot the device 100 in a forward motion; and (e) a control button 380 operatively connected to the motor system 310, the control button 380 functions to turn the motor system 310 on and off, the control button 380 is mounted to the back support portion via a temporary attachment means 382, the temporary attachment means 382 allowing a user to choose a position of the control button 380.

2. The device of claim 1 further comprising straps 140 disposed on the chair component 105 for securing the user in the chair component 105.

3. The device of claim 2, wherein the straps 140 are disposed on the back support portion 120.

4. The device of claim 1, wherein the rocking component 205 comprises a first rocker 210 disposed on a first side and a second rocker 220 disposed on a second side.

5. The device of claim 1, wherein the motor system 310 is operatively connected to a control box 340.

6. The device of claim 5, wherein the control box 340 allows for manipulation of rocking speed.

7. The device of claim 5, wherein the control box 340 allows for manipulation of frequency of rocking.

8. The device of claim wherein the motor system 310 is operatively connected to a power source.

9. The device of claim 8, wherein the power source is a battery or an electrical outlet.

10. The device of claim 1, wherein the motor system 310 is operatively connectable to an electrical outlet via a power cord 350.

11. The device of claim 1, wherein the temporary attachment means 382 is a hook-and-loop fastener mechanism, a magnet mechanism, a snap mechanism, or a combination thereof.

12. The device of claim 1, wherein the control button 380 is further operatively connected to a control box 340.

13. The device of claim 1 further comprising a footrest 150 disposed on the rocking component 205 below the seat portion 110 of the chair component 105.

14. The device of claim 13, wherein the footrest 150 comprises straps for securing the individual's feet on the footrest 150.

15. The device of claim 1, wherein the first side panel 111, the middle panel 113, and the second side panel 112 are each flat panels.

16. The device of claim 1, wherein the temporary attachment means 382 is disposed on the first side panel 111.

17. The device of claim 1, wherein the temporary attachment means 382 is disposed on the second side panel 112.

18. The device of claim 1, wherein the temporary attachment means 382 is disposed along a height of the first side panel 111 or along a height of the second side panel 112.

19. The device of claim 1, wherein a first angle 301 is formed between the first side panel 111 and the middle panel 113, wherein the first angle 301 is between about 90 to 179 degrees.

20. The device of claim 1, wherein a second angle 302 is formed between the first side panel 111 and the middle panel 113, wherein the second angle 302 is between about 90 to 179 degrees.

* * * * *